US008534880B1

(12) United States Patent
Berg et al.

(10) Patent No.: US 8,534,880 B1
(45) Date of Patent: Sep. 17, 2013

(54) SOLID STATE LIGHTING SYSTEM

(75) Inventors: William C. Berg, Lakeville, MN (US); Gary L. Johnson, St. Paul, MN (US); Joshua M. J. Muonio, Lakeville, MN (US)

(73) Assignee: Analog Technologies Corp., Lakeville, MN (US)

( * ) Notice: Subject to any disclaimer, the term of this patent is extended or adjusted under 35 U.S.C. 154(b) by 84 days.

(21) Appl. No.: 13/085,262

(22) Filed: Apr. 12, 2011

Related U.S. Application Data

(60) Provisional application No. 61/323,108, filed on Apr. 12, 2010.

(51) Int. Cl.
*F21V 7/20* (2006.01)

(52) U.S. Cl.
USPC ..... 362/345; 362/346; 362/320; 362/323; 362/218

(58) Field of Classification Search
USPC ..... 362/218, 345, 346, 320, 325
See application file for complete search history.

(56) References Cited

U.S. PATENT DOCUMENTS

| | | | | |
|---|---|---|---|---|
| 6,024,469 | A * | 2/2000 | Greif | 362/346 |
| 7,380,967 | B2 * | 6/2008 | Reed et al. | 362/433 |
| 7,559,676 | B2 * | 7/2009 | Rasmussen et al. | 362/264 |
| 7,607,801 | B2 * | 10/2009 | Suehiro et al. | 362/294 |
| 7,857,488 | B2 * | 12/2010 | Chen et al. | 362/297 |
| 7,997,769 | B2 * | 8/2011 | Foo | 362/294 |
| 8,167,466 | B2 * | 5/2012 | Liu | 362/373 |
| 8,215,799 | B2 * | 7/2012 | Vanden Eynden et al. | 362/294 |
| 8,267,555 | B1 * | 9/2012 | Tsai | 362/373 |
| 8,277,081 | B2 * | 10/2012 | Song et al. | 362/249.02 |
| 2006/0007013 | A1 * | 1/2006 | Singer et al. | 340/815.45 |
| 2007/0081341 | A1 * | 4/2007 | Raos et al. | 362/294 |

* cited by examiner

*Primary Examiner* — Ali Alavi
(74) *Attorney, Agent, or Firm* — Dicke, Billig & Czaja, PLLC

(57) ABSTRACT

A light emitting diode (LED) lighting system and method is inherently configurable into a variety of new and retrofit lamp applications. This reduces fixture costs by incorporating the heat removal method, light guide system, and a chassis into one easy to assemble and install structure. It also allows for configuration of a lighting system for determining overall height, overall inner and outer radii, light directivity, lighting intensity, and thermal performance. In retrofit applications, the lighting system can be configured to minimize installation costs. In a preferred embodiment, a LED lighting system is comprised of sub assemblies of LED circuit strips or arrays conjoined to create a multifaceted structure. Each sub-assembly has LEDs mounted on a circuit substrate with conductors to electrically connect the LEDs. These circuits are thermally interfaced and attached to thermally conductive material selected, treated, or processed to obtain desired light reflecting properties. The thermal conductive material may be formed in any variety of ways, with consideration of surface area, fixture volume envelope and shape, and light directivity. Each LED sub-assembly circuit strip or array is electrically connected in series and/or parallel to a power supply.

17 Claims, 16 Drawing Sheets

8-sided Led Fixture Assembly 16.7 degree tilt

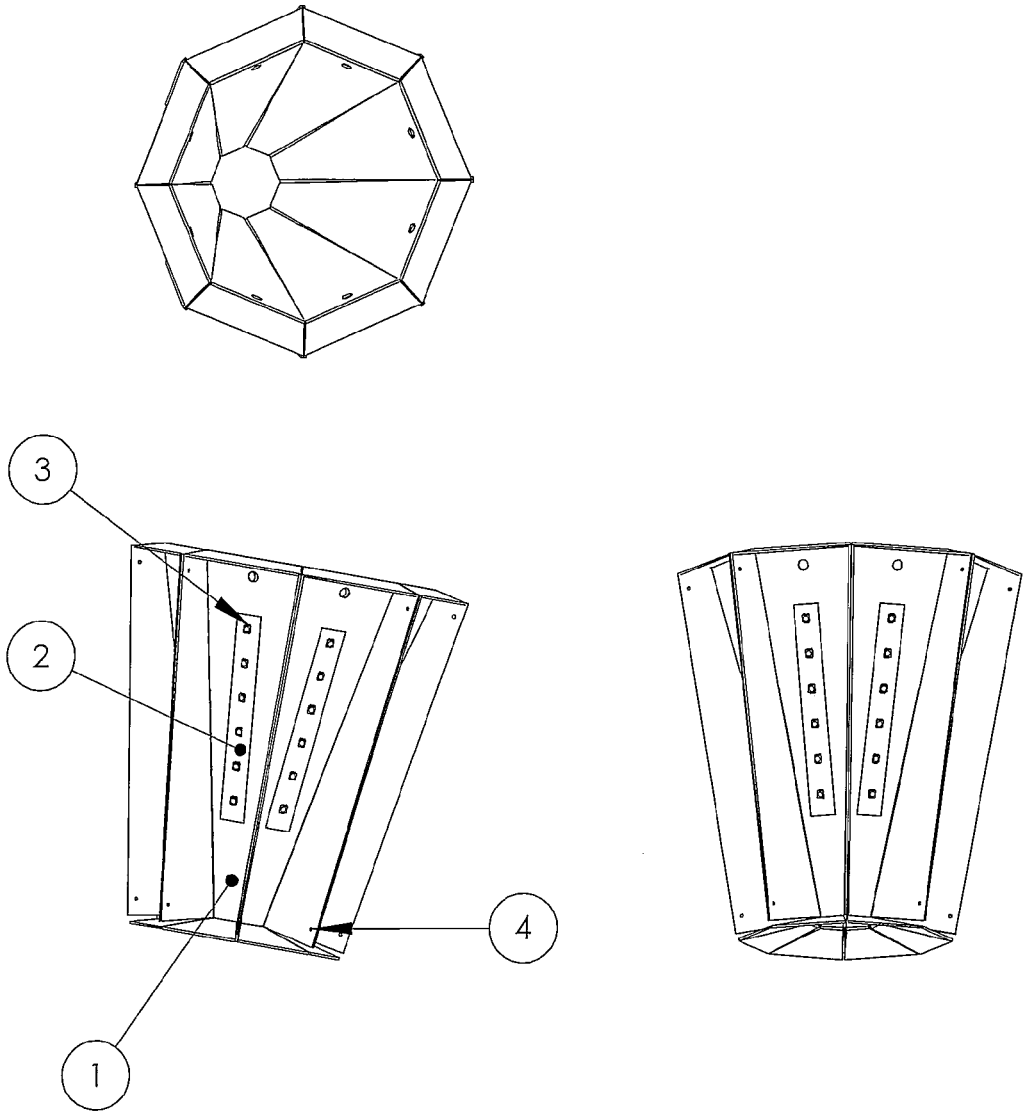
Figure 1 - 8-sided Led Fixture Assembly 16.7 degree tilt

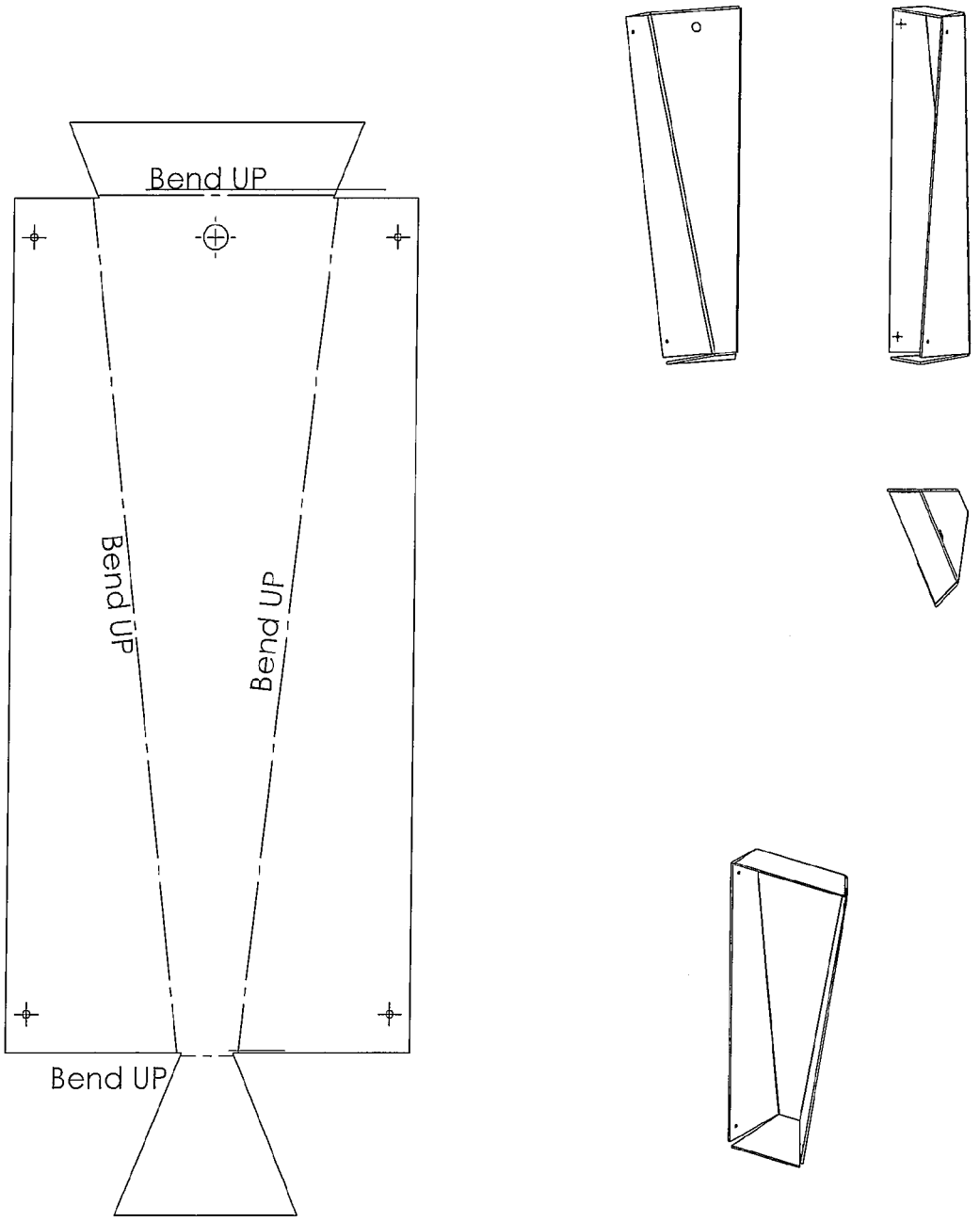
Figure 2 - Heatsink for 8 sided assembly - 16.7 degree tilt

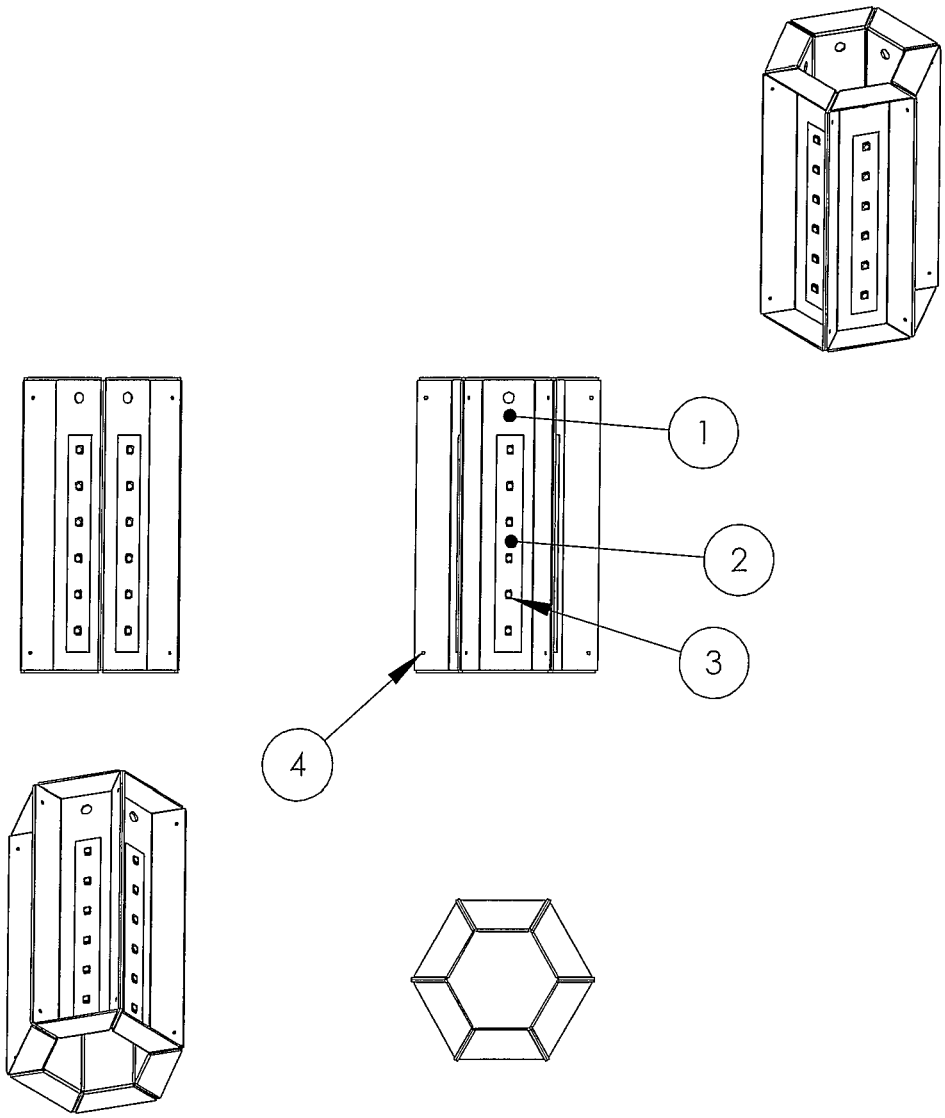
Figure 3 - Six Sided configuration 0 degree tilt

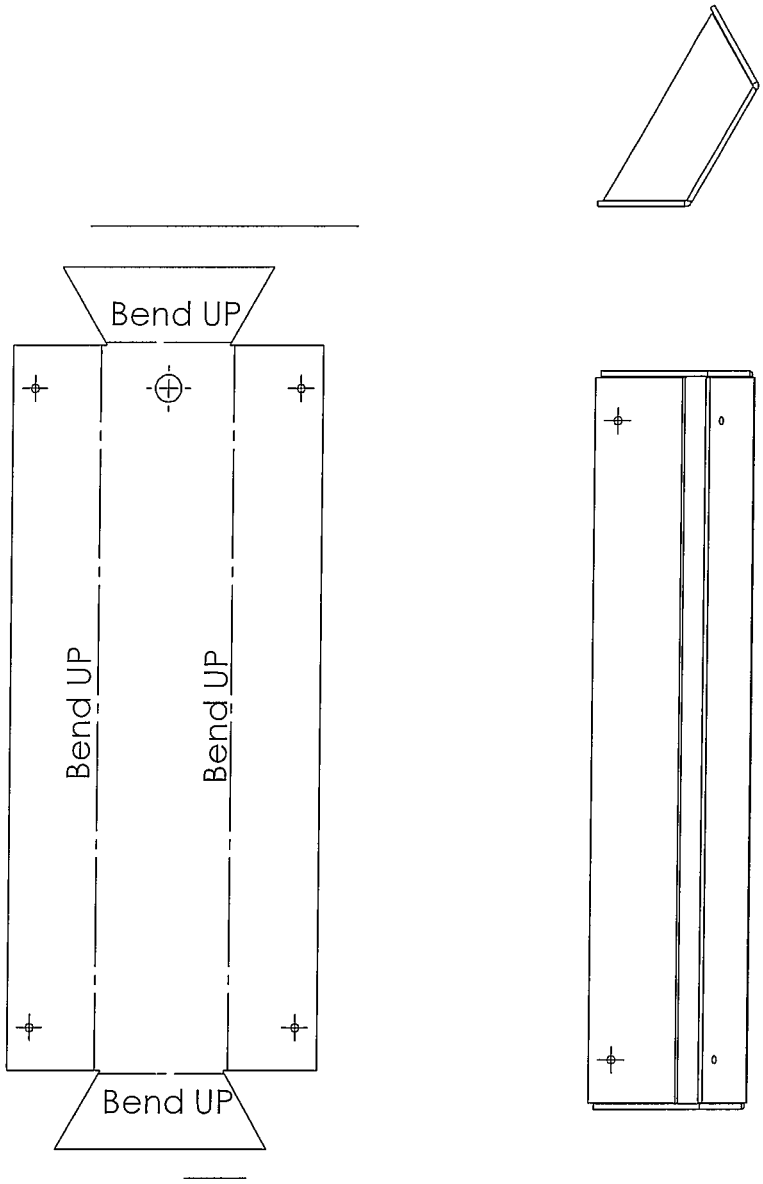
Figure 4 - Heatsink six sided 0 degree tilt

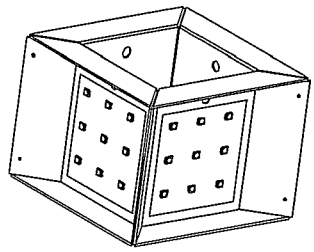
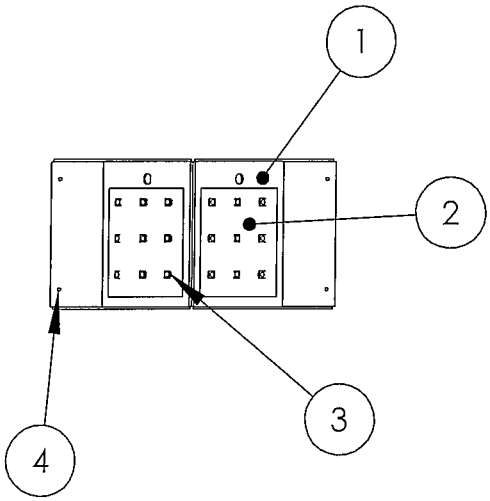
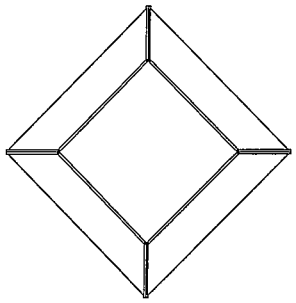
Figure 5 - 4 Sided Assembly o degree tilt

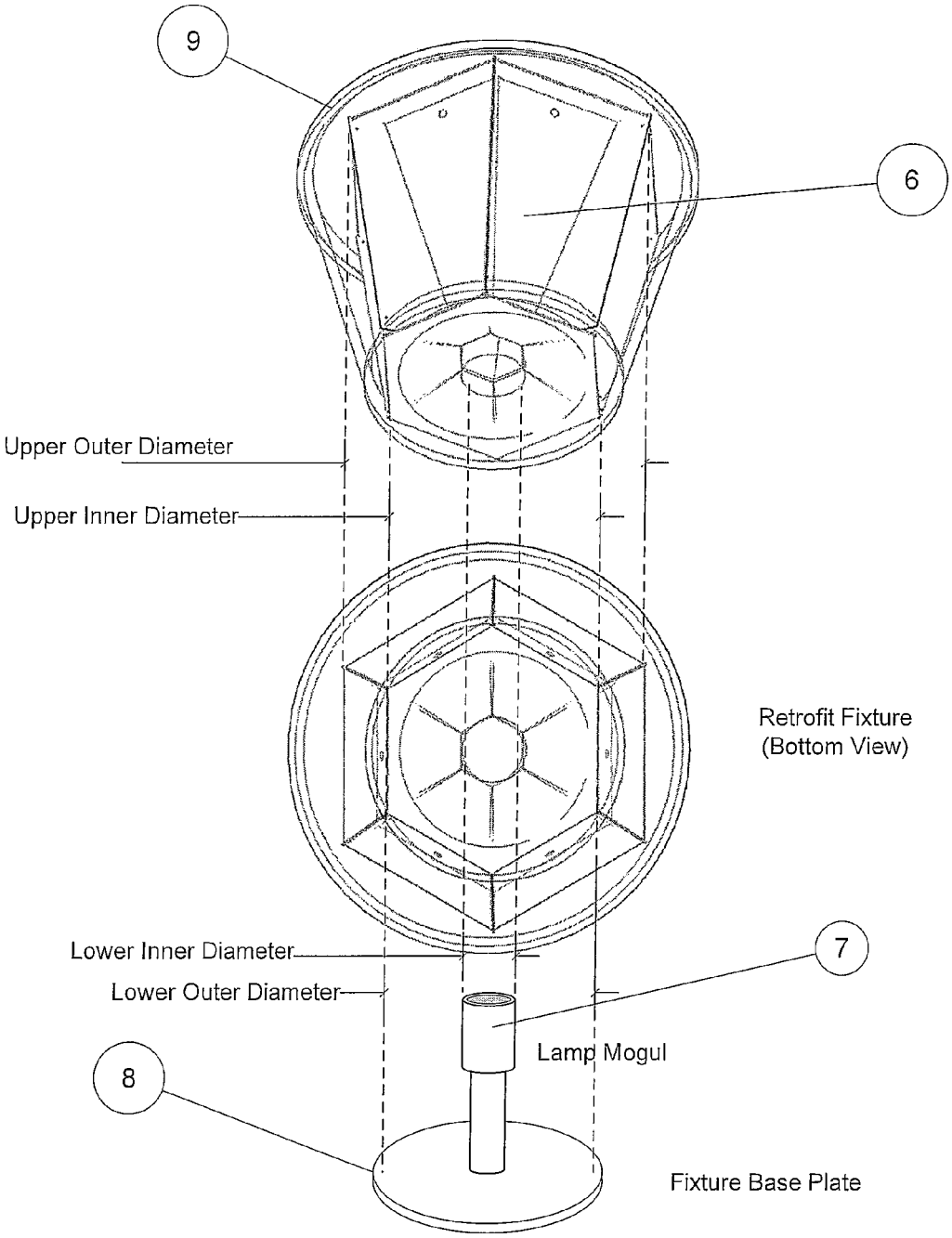
Figure 6 - Six Sided Led Fixture Assembly 16.7 Degree Tilt

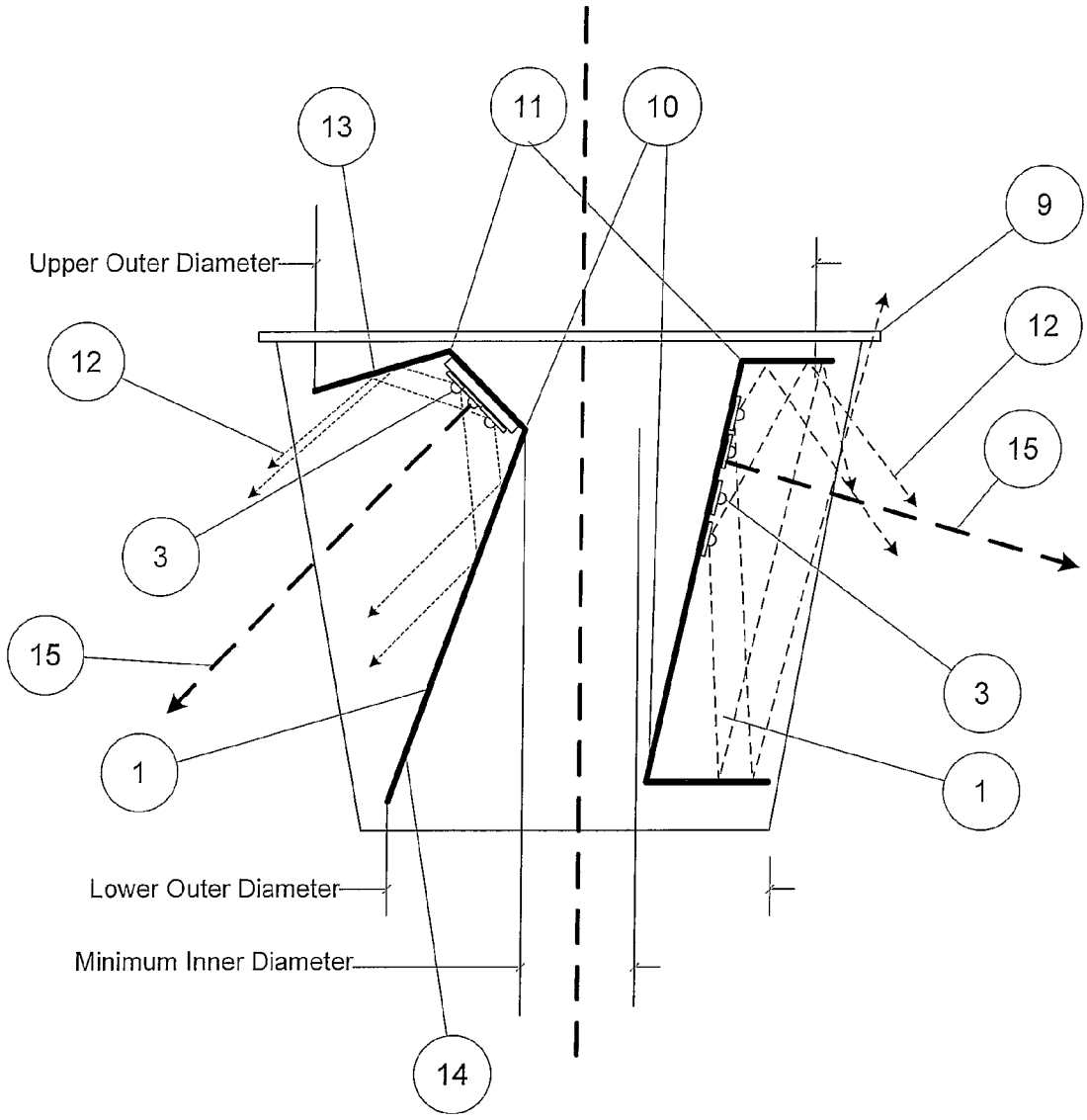
Figure 7 – Cross Sectional View Illustrating Light Ray Traces Comparison By Moving the Horizontal Fold Line

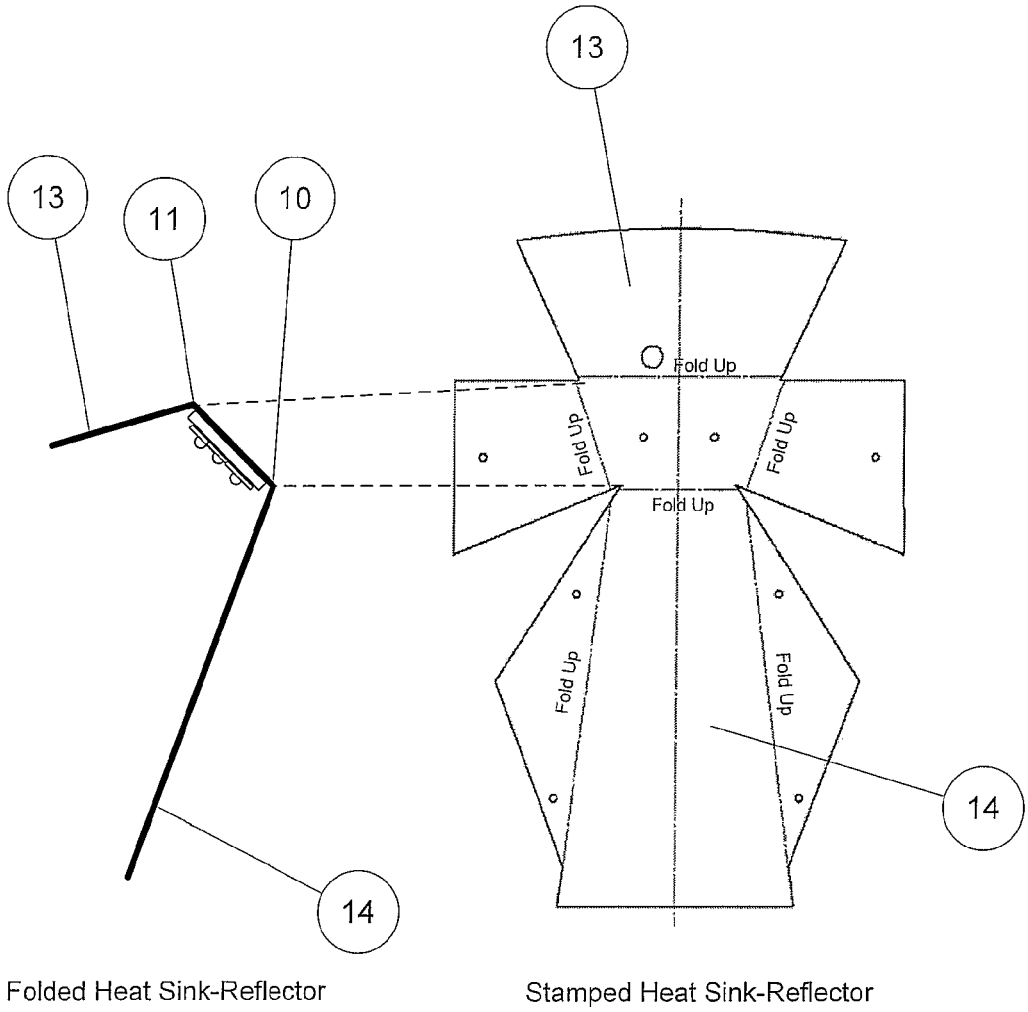
Figure 8 – Heat Sink-Reflector for Six Sided Fixture With Improved Directivity

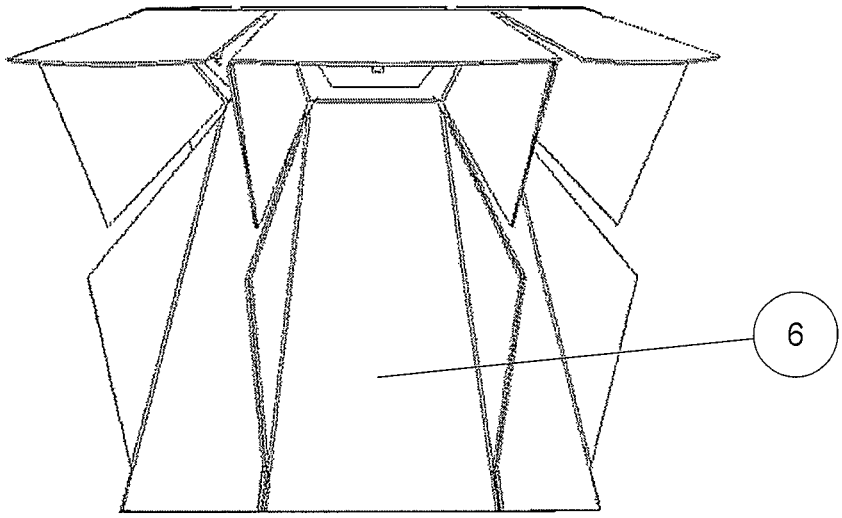
Figure 9 - Six Sided Fixture with Improved Light Directivity

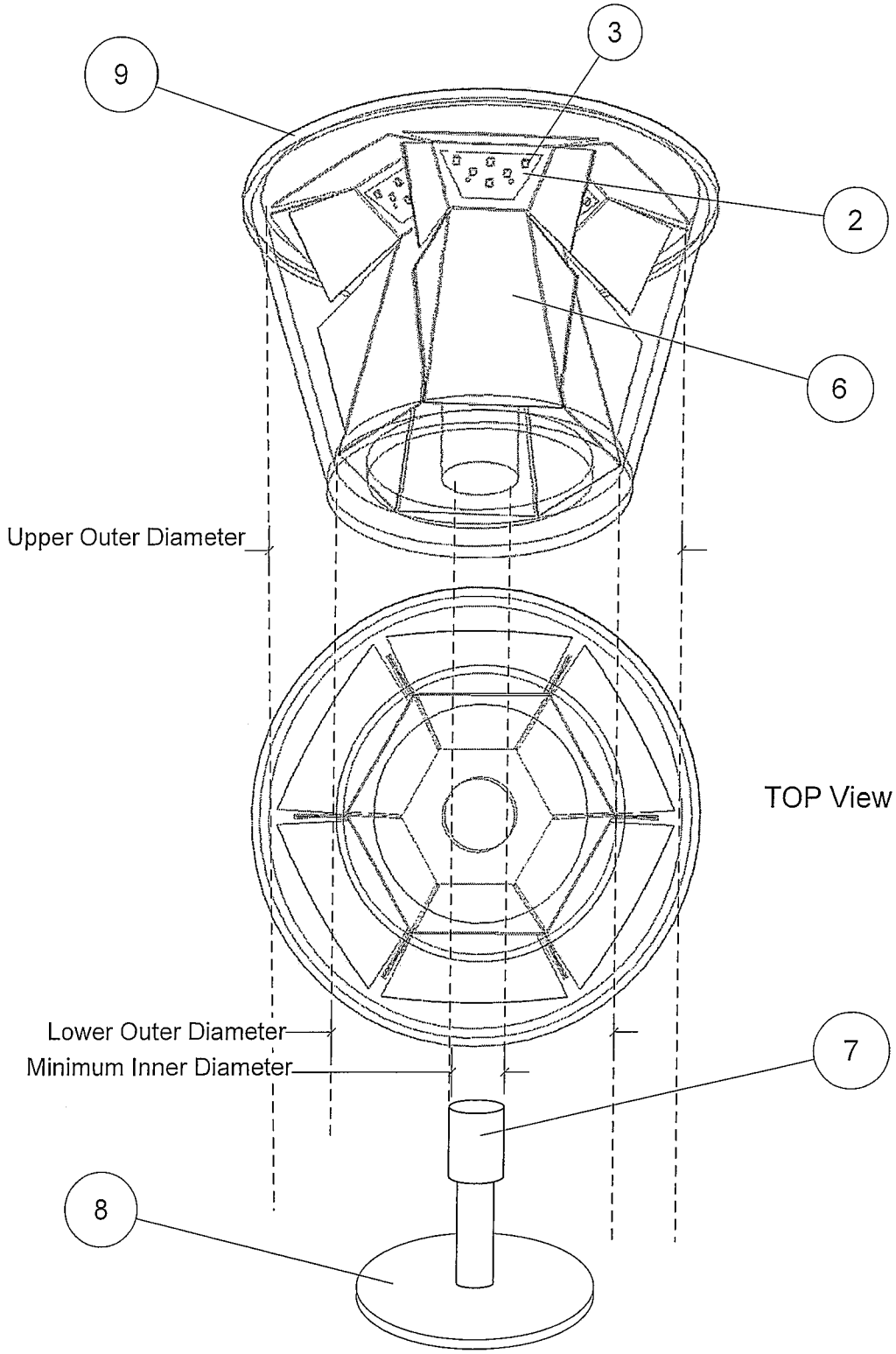
Figure 10 - Six Sided Fixture With Improved Directivity

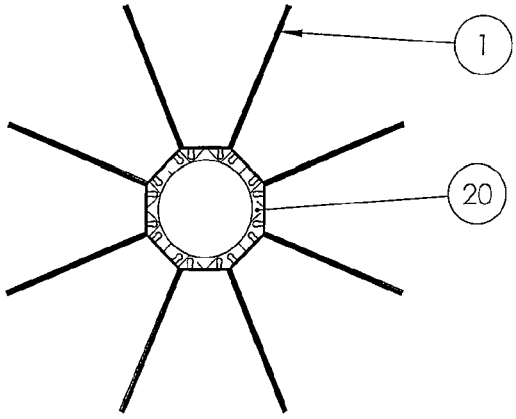
SECTION
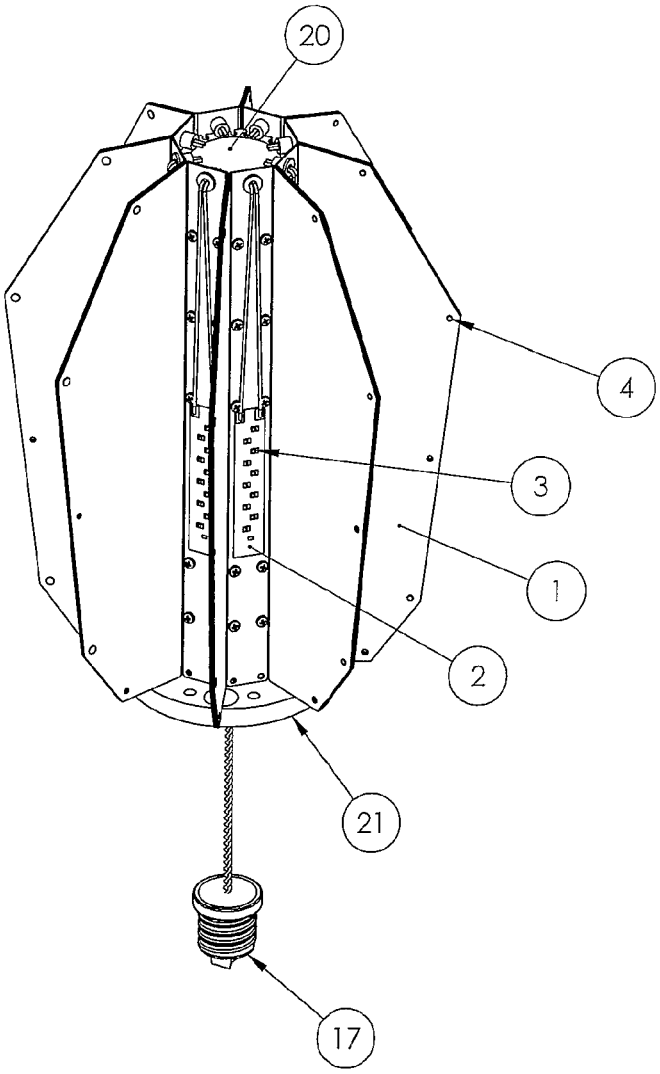
Figure 11: 8-Sided LED Fixture Assembly w/ Extruded Heat Sink

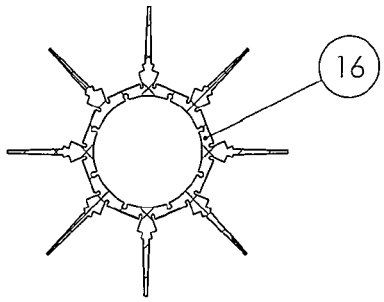
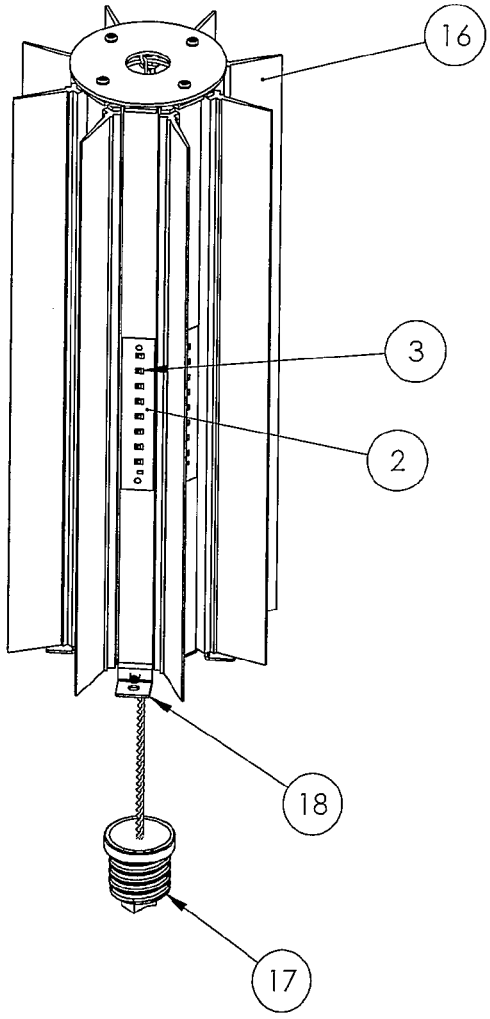
Figure 12: 8-Sided LED Fixture Assembly w/ Extruded Fins and Heat Sink

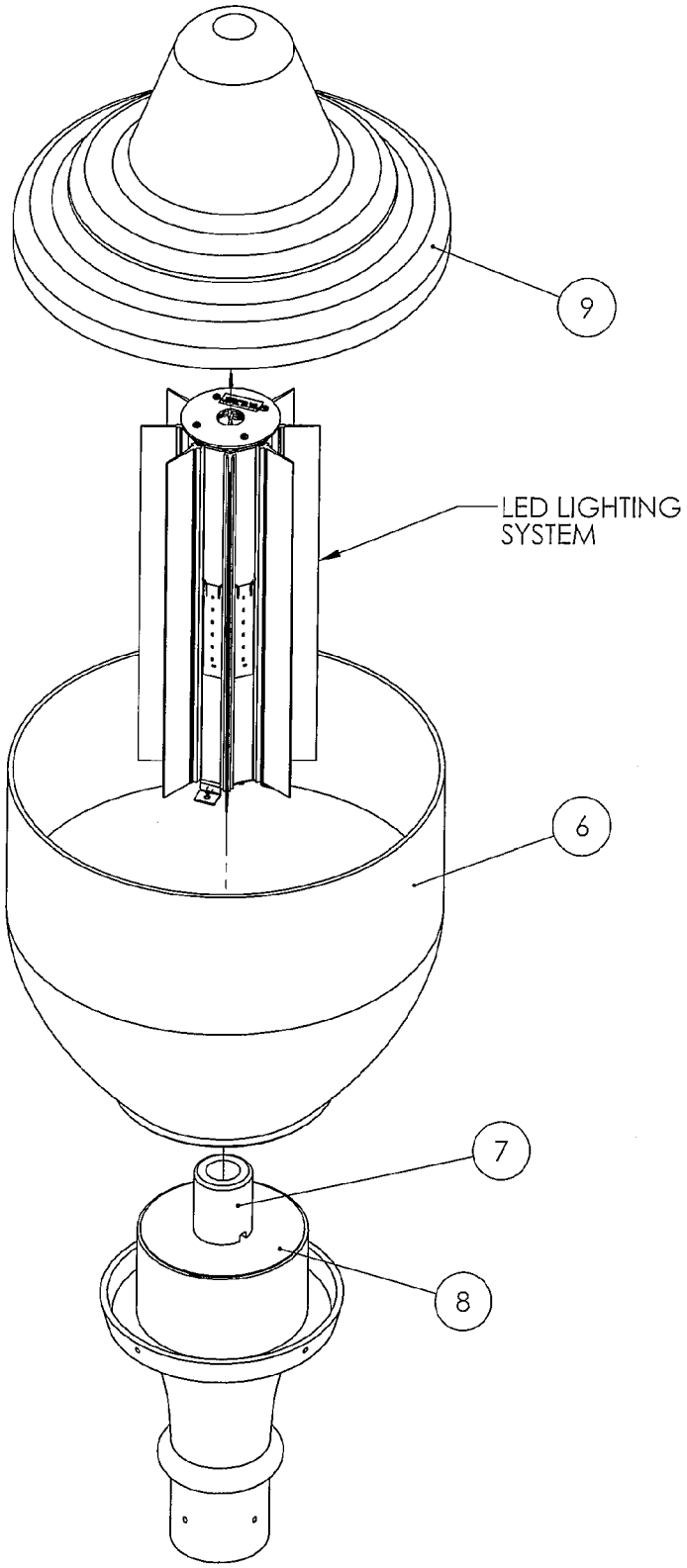
Figure 13: 8-Sided LED Fixture Assembly

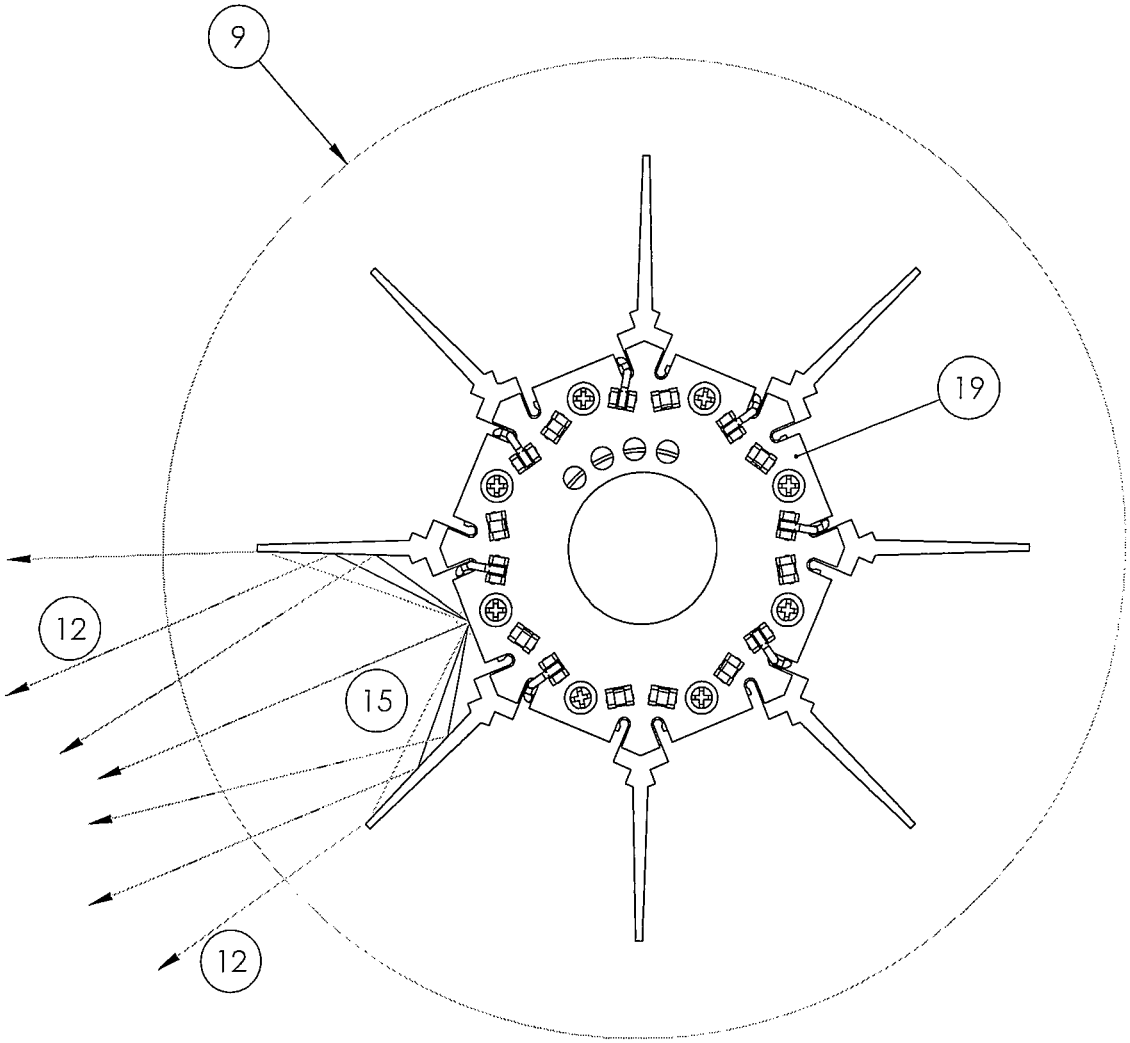
Figure 14: Sectional View Illustrating Light Ray Traces Between Fins

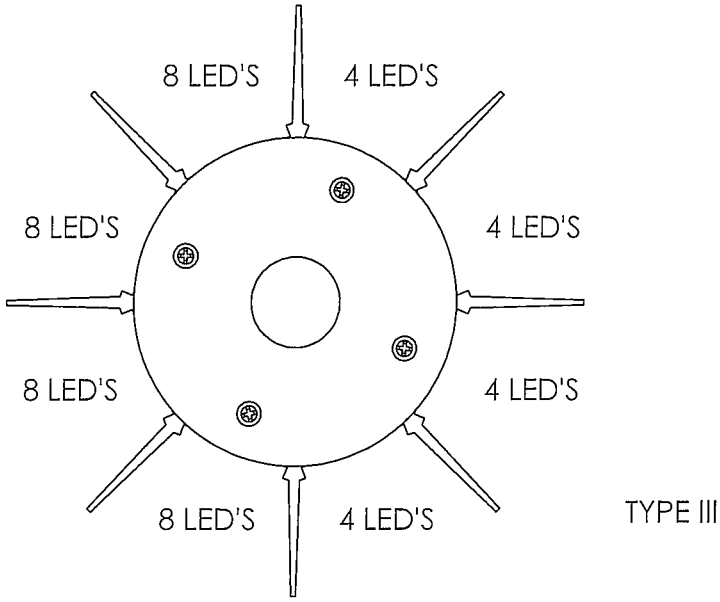
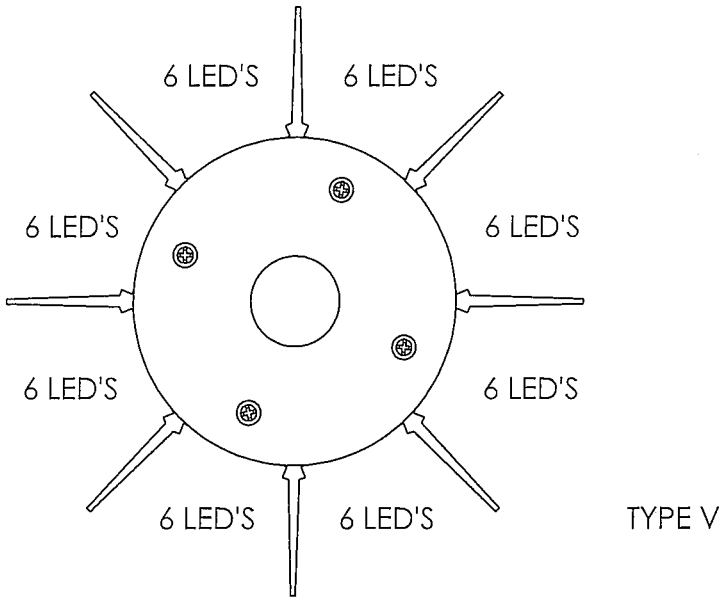
Figure 15: Type III and Type V Light Patterns

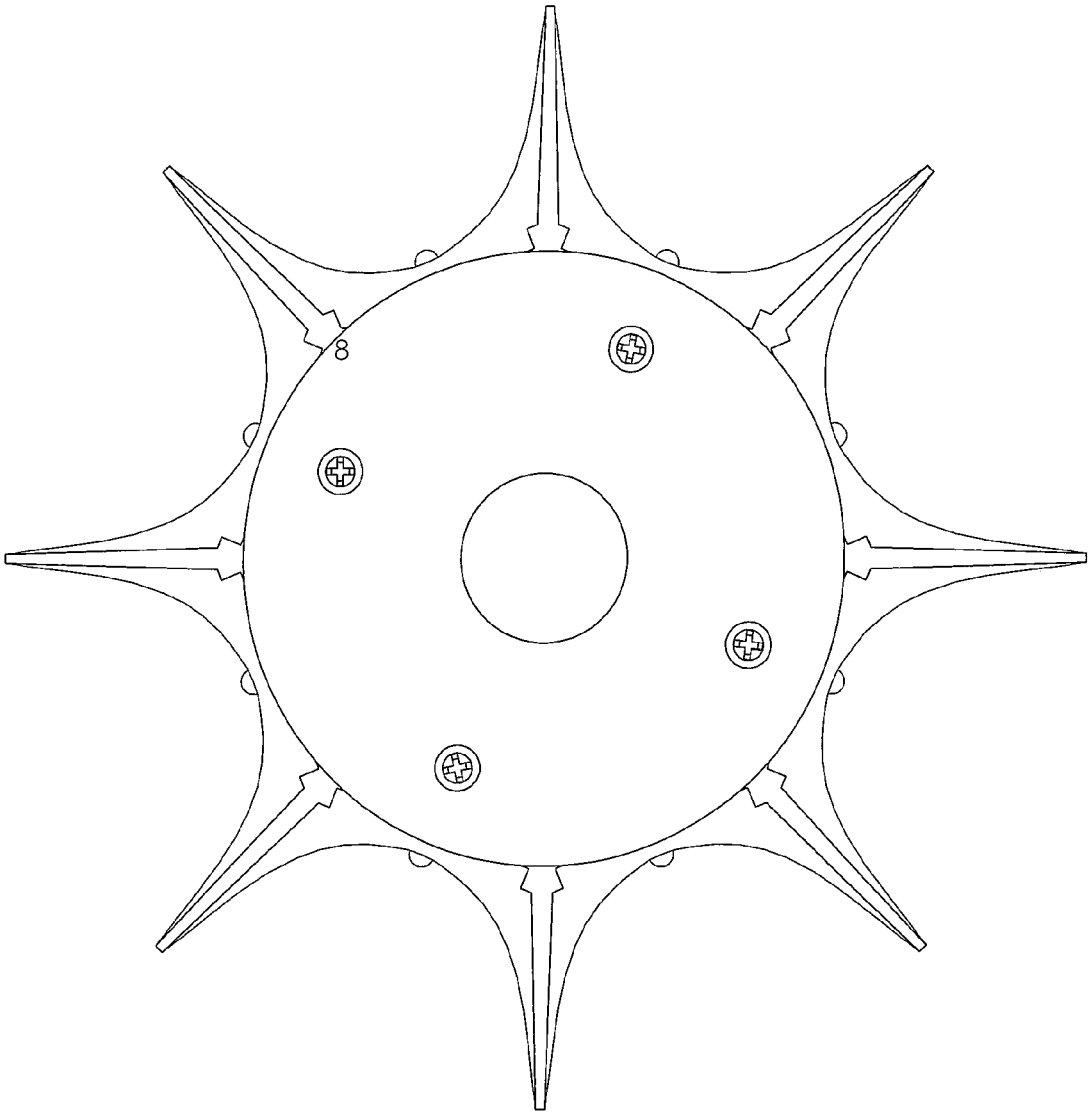
Figure 16: Optically Engineered Reflecting Surface

SOLID STATE LIGHTING SYSTEM

CROSS REFERENCE TO RELATED APPLICATION

This application claims priority to U.S. provisional patent application No. 61/323,108 filed Apr. 12, 2010.

TECHNICAL FIELD

This application concerns solid state lighting systems using light emitting diodes (LEDs).

BACKGROUND

The incandescent bulb has been utilized for over a century. Millions of fixtures using standardized incandescent lamps are in use. The white light LED (Light Emitting Diode) was invented in the early 1990's. Since then, the efficacy of white light LEDs have improved dramatically. Power efficiencies and product life have since surpassed the incandescent bulb. The LED emitted light relative to its cost is currently substantially higher than an incandescent, however.

To efficiently use the higher cost LED light, lenses and reflectors are oven used to direct or guide the light to the intended illumination area. Reflectors and lenses add cost to a LED fixture. LEDs dissipate power and generate heat. For long term reliability and to extend product life, heat must be removed from the LED. A thermal management system, including heat sinking, adds even more cost to a LED fixture.

In new lighting applications the decision to use a LED fixture depends on fixture, installation, and maintenance costs as well as energy savings. The decision to replace or retrofit an incandescent fixture in an existing lighting application may also depend on the original fixture value. Many fixtures have significant value above and beyond replacement costs including sentimental, historical, or architectural. While LED lighting may offer lower energy and maintenance costs, the decision to replace often depends on upfront costs and the capital required.

In many LED fixtures using arrays or multiple LED emitters, emitter "hot spots" (small areas of intense light embedded in a larger area of relative darkness) are visible and cosmetically undesirable. While diffusers may be used, they introduce losses in performance (intensity and other factors).

SUMMARY

The systems and methods described in this application lower the fixture and installation costs for both new and retrofit LED lighting applications.

In one embodiment, a LED lighting system and method that is inherently configurable into a variety of new and retrofit lamp applications. The invention reduces fixture costs by incorporating the heat removal method, light guide system, and a chassis into one easy to assemble and install structure. The invention allows for configuration of a lighting system for determining overall height, overall inner and outer radii, light directivity, lighting intensity, and thermal performance. In retrofit applications, the lighting system can be configured to minimize installation costs. It is also possible to incorporate a method to improve the LED light source appearance by using prismatic or diffused fixture lenses.

Specifically, a light emitting diode (LED) lighting system is comprised of sub-assemblies of LED circuit strips or arrays conjoined to create a multifaceted structure. Each sub-assembly has LEDs mounted on a circuit substrate with conductors to electrically connect the LEDs. These circuits are thermally interfaced and attached to thermally conductive material such as but not limited to aluminum, copper, or brass. This material is also selected, treated, or processed to obtain desired light reflecting properties. The thermal conductive material is cut and formed, shaped, or extruded with consideration of surface area, thermal mass, fixture volume envelope and shape, and light directivity. Each LED sub-assembly circuit strip or array is electrically connected in series and/or parallel to a power supply.

The characteristic heat sink-reflector fin elements described in this application also add a significant cosmetic improvement to the resultant light. When used with a prismatic or frosted lens, the embodiments described in this application slightly scatter or diffuse light, reducing or eliminating the appearance of individual emitter light hot spots. This creates a pleasing appearance more like an incandescent filament to which the public is accustomed, without the light losses associated with a diffuser.

BRIEF DESCRIPTION OF DRAWINGS

The accompanying drawings show a particular embodiment as an example, and are not intended to limit the scope of this disclosure, application, or claim(s).

FIG. 1 is a diagram of an example of an 8-sided fixture with a 16.7 degree angle of incidence for the strips 2 of LEDs 3. There are eight sub-assemblies 1 conjoined by fasteners 4 to form the fixture.

FIG. 2 is a diagram of an example of a cut and formed sub-assembly heat sink/reflector used in an 8-sided fixture with a 16.7 degree angle of incidence.

FIG. 3 is a diagram of an example of an 6-sided fixture with a 0 degree angle of incidence for the strips 2 of LEDs 3. There are six sub-assemblies 1 conjoined by fasteners 4 to form the fixture.

FIG. 4 is a diagram of an example of a cut and formed sub-assembly heat sink/reflector used in an 8-sided fixture with a 0 degree angle of incidence.

FIG. 5 is a diagram of an example of an 4-sided fixture with a 0 degree angle of incidence for the arrays 2 of LEDs 3. There are four sub-assemblies 1 conjoined by fasteners 4 to form the fixture.

FIG. 6 is a diagram of example of a 6-sided fixture with a 16.7 degree angle of incidence in a retrofit application. The fixture's lower inner diameter allows the fixture to fit over the existing lamp mogul-base or bulb socket.

FIG. 7 illustrates a method of setting or improving light ray directivity by adjusting the horizontal bend lines for multi-section folded sheet metal embodiments.

FIG. 8 is an illustration of an unfolded heat sink-reflector section of a six sided fixture with improved directivity.

FIG. 9 is an illustration of a portion of a six sided fixture with improved directivity of the light.

FIG. 10 is an illustration of an assembled version of the fixture of FIG. 9 with relationship to the geometry of the mogul base 7 and mounting plate 8.

FIG. 11 illustrates a hybrid fixture embodiment incorporating eight elements of folded sheet metal heat sink-reflectors 1 mounted on an extruded head spreader 15.

FIG. 12 shows an eight sided, single piece, extruded aluminum embodiment with mogul base adapter plug 17 and base mounting tab 18.

FIG. 13 depicts an exploded view of an eight sided, single piece, extruded aluminum lighting fixture embodiment in along with its associated mogul base 7, mounting plate 8, and lens 9.

FIG. 14 shows a sectional view of the top of an eight sided extruded embodiment and ray trace 12 illustrating scattering of light between heat sink-reflector fins.

FIG. 15 illustrates LED configuration for Type III and Type V light patterns associated with street lamps.

FIG. 16 illustrates an extrusion embodiment with an optically engineered reflector.

DETAILED DESCRIPTION

The lighting system is comprised of sub-assemblies of LED circuit strips or arrays conjoined to create a multifaceted structure. Depending on the construction, the light reflective surfaces may be facing outwardly from the central (vertical) axis of the assembly, or they may be arranged radially outwardly from that axis. In general, the former configuration is implemented in the sheet metal embodiments described below, while the latter configuration is implemented using extruded materials, also described below.

In general, regardless of embodiment, each sub-assembly has heat sink-reflector, a LED circuit strip, and electrical conductors. A lighting designer will configure a system to principally meet illumination, thermal, and mechanical fit requirements. The designer will determine the number of LEDs, the LED incident angle, the number of sides or facets, the fixture inner radius, the fixture outer radius, and fixture height.

Heat Sink-Reflector

The heat sink reflector 1 is formed from conductive metals or materials. These materials may include, but are not limited to, aluminum, brass, ceramic, or steel. The material chosen will affect fixture thermal performance, cost, and light reflection properties. The chosen material can be die cut, cut, formed, stamped or extruded. Selection will depend on material properties, processing quantities, or costs. The heat sinking properties of the heat sink reflector 1 is directly related to its surface area, thickness or mass, and thermal conductivity. (Because the area is essentially determined by the length or height of the assembly and the fin length, the number of faces in the polygon and either the surface area needed for heat sinking the dissipated power—or the maximum available surface area if constrained by the space or volume—may be determined.)

In a aluminum sheet metal embodiment illustrated in FIG. 1, an eight sided fixture is constructed using eight sections of conjoined heat-sink reflector subassemblies. FIG. 2 details single section construction from cut and folded sheet aluminum. An aluminum section is folded along fold lines on each edge (FIG. 2). The lengths of the pieces along the fold lines determine fixture height, inside diameter, outside diameter, and the angle of incidence. The fixture's inside diameter corresponds to the width of the fold line at the bottom of the piece. The outer diameter of the fixture corresponds to the width of the top edge above the fold line. The fixture's height corresponds to the length of the fold line multiplied by the cosine of the angle of incidence.

In an extruded embodiment, for example that illustrated in FIG. 11, aluminum is extruded through an extrusion die to determine the fixture's inner diameter, outer diameter, number of facets, and reflector shape. The resulting extruded heat sink-reflector is cut to the desired length. The shape or pattern of the die can be optimized to maximize the extrusions heat sinking properties and/or light reflection properties. The example of FIG. 12 illustrates an embodiment with the objective of mixing, scattering or diffusing the emitted light while providing sufficient surface area for heat sinking. The example of FIG. 14 shows another variation of the extrusion embodiment with the objective of directing or collimating light rays horizontally relative to the fixture. In a third embodiment, FIG. 10, a hybrid combination of cut and folded sheet metal is used. The extrusion functions as a thermal mass and chassis to mount heat sink-reflectors onto. Cut and folded heat sink-reflector sub-assemblies 1 are then mounted to an extrusion 20.

Multi-section folded sheet metal embodiments allow emitted light directivity control in horizontal and vertical directions. FIG. 8 shows how adjusting the fold lines 10, 11 can affect emitted light directivity. In many street light applications, it is desirable to minimize or eliminate light directed skyward. The left side section of FIG. 8 illustrates how one could configure the heat sink-reflector 1 and minimize skyward directed light. The properties of light lens 9 will affect configuration decisions and ultimate light performance. In more expensive and/or higher powered incandescent lamp fixtures, the lens 9 is often designed to direct or guide light such as a prismatic lens. In less expensive and/or lower powered fixtures, a clear or frosted lens 9 is often used. Clear lenses do not offer light control or directivity. Emitted light will mostly pass through the clear lens close to its angle of incidence. Frosted lenses will diffuse, scatter, and absorb emitted light. The inventions multi-section folded sheet metal embodiment offers directivity and control in retrofit applications with objectives to minimize skyward light or improve directed light to specific areas.

Multi-section folded sheet metal embodiments configured with a 0° incident angle (tilt) or metal extrusion embodiments do not allow directivity adjustments from the horizontal (FIG. 3, FIG. 5, FIG. 11, FIG. 12). These configurations are best suited for retrofit light applications with prismatic or frosted lenses. In retrofit applications with prismatic lenses, the prismatic lenses are usually designed to direct or guide the light based on an incandescent bulb filament. To achieve similar light directivity performance, a simple and practical strategy is to locate the LEDs in the same vertical location as the incandescent bulb filament.

The characteristic fins separating each LED circuit strip section perform two important functions. First, they increase the surface area of the heat sink Second, they also perform a light reflector function. In the embodiment illustrated in FIG. 14, the extruded fins acts to slightly scatter, mix or diffuse emitted light. When this heat sink-reflector is used with a prismatic or diffused lens, light is still efficiently directed to the lens. The multiple reflections occurring within each section diffuses the hot spot usually associated with the center of each individual LED emitter. This feature is particularly useful with prismatic lenses where the original light fixture did not incorporate diffusion. Cosmetically, the resultant light appearance of the fixture looks more like an incandescent source than an array of LEDs.

The finish of the heat sink-reflector 1 is selected for the desired light reflection properties. Reflections off of the surface can be specular or diffused or a combination. A surface with a specular reflective finish would reflect light at the same angle as its incidence. These finishes include but are not limited to polished aluminum, highly reflective coatings such as glossy white paint, and highly reflective films applied to the heat sink reflector. Anolux MIRO-SILVER® brand sheet (supplied by Anomet, Inc. and/or Alanod GmbH & Co. KG) is an example of a specular reflective aluminum sheet product. The aluminum sheet has good thermal conductivity and high reflectivity. These properties allow the heat sink-reflector 1 to both efficiently conduct heat away from the LEDs 3 and to efficiently reflect their incident light. A surface with a diffused reflective finish scatters light at angles mostly different than its incidence angle. A diffused heat sink reflector surface finish can be formed from using unpolished aluminum, by applying diffusion films, or processing the heat sink-reflector surface with chemicals or machining to achieve patterned or random surface textures to scatter incident light.

LEDs

The Light Emitting Diodes (LEDs) 3 emit electromagnetic radiation. The preferred embodiment uses visible white light LEDs, but the systems and methods described here are not limited to white light and may include other visible colored light or invisible wavelengths of light including infrared and ultraviolet. The LEDs require current to emit light. Upon application of current, a forward voltage is induced, the LED dissipates power, and heat is produced.

LED Circuit Strip

The LED circuit strip 2 is mounted on the heat sink reflector. The LED circuit strip consists of LEDs, an insulating dielectric, conductive traces, and a means to connect power to the strip. The LEDs can connect in a series or parallel or a combination of series and parallel circuit arrangement. The traces conduct electric current to the LEDs connected to each other and to a connector or wire termination pads. The preferred embodiment uses traces created by etching copper off of an insulating dielectric such as FR4 epoxy glass, silicone, or polyimide. The insulating dielectric may also reside on an aluminum or metal core board or supporting element. Conductive traces may be also be formed by other means including (but not limited to) metal deposition or conductive epoxy dispensing, or conductive ink printing.

Thermal Interface

To remove heat from LEDs, the circuit strip must thermally interface to the heat sink reflector. The preferred embodiment uses pressure sensitive thermal adhesive to join the circuit substrate to the heat sink-reflector. Other joining methods could be used including thermally conductive epoxy and using hardware fasteners and thermal grease.

Fixture Structure and Chassis

In the multi-sectioned cut and folded sheet metal heat sink-reflector embodiments, the conjoined heat sink-reflector LED circuit sub-assemblies inherently form a stable structure and mechanically strong chassis. Each subassembly is joined with mechanical fasteners 4 such as (but not limited to) screws and nuts, rivets, clips, or welded or bonded with adhesives (for example, thermally conductive epoxy). In a preferred retrofit application embodiment, the fixture fits over the existing mogul or socket 7 and rests on a predefined surface 8 within the retrofit application.

Mounting brackets or tabs 18 may be necessary to mount the assembly into the retrofit fixture application. In the extruded heat sink-reflector embodiments (FIG. 11), the extrusion and fins form a stable and mechanically strong chassis. A single piece extrusion may not require sub-assembly joining or fastening, however multiple extruded sub-assembly sections would. The multiple extruded sub-assemblies could be joined or fastened similarly to the cut and folded sheet metal embodiments. Alternatively, interlocking features incorporated into the extrusions could also be used to join the sections together.

Electrical Connection

Electrical wires are connected to each sub-assembly circuit strip either by soldering to contact pads or by using connectors. The wires are routed through holes or openings in the heat sink-reflector or through channel features incorporated in the surface of extruded versions.

In one embodiment, an adapter plug 17 is mechanically and electrically compatible with an existing mogul base or socket 7. In many retrofit applications, the existing power supply, ballast, or both is or are replaced with an appropriate LED driving and optimized power supply.

Configuration

The embodiments disclosed in this application allow for a considerable number of easily accomplished configurations. For multi-section folded sheet metal embodiments, the fixture's height and diameter are easily set by the geometry of the cut-out or stamped heat-sink reflector. In a retrofit application, the height and diameter are constrained by the existing fixture. FIG. 6 illustrates an example of a six sided fixture for retrofitting a street lamp. One could remove the mogul socket 7 to allow for more space and design flexibility for the fixture. This takes time during the installation procedure, however. The extra time and complexity of the removal adds cost to the installation. It is desirable to keep the mogul socket in the existing light fixture, and use the socket to conduct power to the retrofit fixture. The mogul socket determines the minimum inner diameter of the fixture. The height in this example is constrained by the lens 9 of the existing fixture. Outer diameter at the top and bottom of the retrofit fixture are also determined by the lens. In this embodiment, the retrofit fixture fits over the mogul socket and rests on the base plate 8 of the existing fixture.

The light directivity is set by angle of the LEDs mounted on the heat sink reflector, the LED beam angle, the presence of top and or bottom reflector tabs, angles of the top and bottom reflectors, and the location of the LEDs on the heat sink reflector. In many applications, it is desirable to direct the light downward. The right hand side of FIG. 7 shows ray traces of light 12 emanating from the LEDs. Most of the LED light radiates in the direction normal to the surface the LED is mounted on. This is indicated by the heavy dotted line 15. In this embodiment, The LEDs are mounted close to the top of the retrofit fixture to minimize light radiating upwards. In this embodiment, the maximum incident angle of the LED is determined by the height of the retrofit fixture, and the radius of the fixture. The left half of FIG. 7 shows a method to increase the LED incident angle within the same fixture. The LED incident angle can be increased by moving the lower horizontal fold line 10 up. The upper fold line 11 and the angle formed by the tab forms an upper reflector 13. This upper reflector 13 minimizes light from radiating upward and improves directivity. The angle set by this upper reflector 13 will determine the distance from the LED source the light will ultimately reach and illuminate. The angle of the lower reflector 14 below the lower fold line 10 will largely determine the minimum distance from the LED source that the light will reach. In this embodiment, The LEDs are mounted in a tight array between all the fold lines. Keeping the array area small improves control of the light directivity. Each subassembly may have different tab angles set to create a radiation pattern specific to an application.

Each sub-assembly or section may also have different number of LEDs or light flux radiating from the LED circuit assembly. In many applications, such as street lights, it is desirable to provide a high intensity on a side, such as the street side, and a lower intensity on the other side, such as the sidewalk side or house side. This is known as a "Type 3" pattern. A "Type 5" pattern has a uniform 360° light pattern.

FIG. 9 illustrates an embodiment using the number of LEDs to set the light intensity pattern. The number of facets with fins along with the number of LEDs within each section can also be used to determine the intensity pattern. For example if there are eight facets with eight fins, Each LED circuit section corresponds to 45°. The configuration allows for a 45° increments of resolution. In a Type 3 pattern, the fixture could have four sections with eight LEDs on the street side and four sections with four LEDs on the house side. One could also configure the fixture with five sides of eight LEDs and three sides of four LEDs.

For multi-section folded sheet metal embodiments, a combination of the number of facets, number of LEDs on each facet, LED incident angle, and reflector tab angles are configuration variables used to achieve a desired lighting pattern. In multi-section folded sheet metal embodiments configured with 0° angle of incidence (tilt) or metal extrusion embodiments, the principal configuration variables are the number of facets, the number of LEDs mounted on each facet, the length of the extrusion or fixture, and the position of the LEDs on each facet.

We claim:

1. A solid state lighting fixture, comprising: a plurality of combinations of: (1) a thermally conductive light radiation reflector and (2) at least one light emitting diode (LED) circuit thermally joined to the thermally conductive reflector; in which the thermally conductive light radiation reflectors are conjoined together into an assembly.

2. The fixture of claim 1, in which the fixture has a central axis and each thermally conductive light radiation reflector comprises at least one reflective surface facing outwardly from the central axis.

3. The fixture of claim 1, in which the fixture has a central axis and each thermally conductive light radiation reflector comprises at least one extruded thermally conductive and light reflective fin arranged radially outwardly from the central axis.

4. The fixture of claim 1, in which there are at least six thermally conductive light radiation reflectors.

5. The fixture of claim 1, in which there are at least eight thermally conductive light radiation reflectors.

6. The fixture of claim 1, in which each thermally conductive light radiation reflector has a major surface which forms an angle of incidence, measured from vertical which is greater than zero.

7. The fixture of claim 1, in which each thermally conductive light radiation reflector is extruded material.

8. The fixture of claim 1, in which the fixture emits light in one of a Type III pattern and a Type V pattern.

9. The fixture of claim 1, further comprising a lens.

10. A solid state lighting fixture presenting a diffused light from light emitting diode (LED) emitters with minimal hot spots and loss of intensity, comprising, in combination, a plurality of LED emitter circuits thermally joined to at least one thermally conductive reflector having a plurality of specular reflective surfaces, and at least one of a prismatic or frosted lens, whereby the plurality of surfaces partially diffuses light by multiple reflections prior to transmission out of the fixture.

11. A method of retrofitting an existing lighting fixture with a solid state lighting system using light emitting diodes (LEDs), in which the existing lighting fixture has a height; a first, upper inner diameter; and a second, lower inner diameter; the existing lighting fixture further comprising a light mogul having a fixed outer diameter; in which the method comprises: (a) providing a plurality of thermally conductive light radiation reflectors conjoined together into an assembly having a height not greater than the height of the existing lighting fixture, upper and lower outer diameters each not greater than the respective upper and lower inner diameters of the existing lighting fixture, and an inner diameter greater than the fixed outer diameter of the light mogul; each thermally conductive light radiation reflectors comprising a combination of (1) a thermally conductive light radiation reflector and (2) at least one light emitting diode (LED) circuit thermally joined to that thermally conductive reflector.

12. The method of claim 11, in which the method further comprises placing the assembly on a predefined surface beneath the light mogul.

13. The method of claim 11, in which the method further comprises placing the assembly beneath an existing lens of the existing light fixture.

14. The method of claim 11, in which the method further comprises providing the assembly with an adapter plug mechanically and electrically compatible with the light mogul.

15. The method of claim 11, in which the assembly has a central axis and the method further comprises providing each thermally conductive light radiation reflector with at least one reflective surface facing outwardly from the central axis.

16. The method of claim 11, in which the assembly has a central axis and the method further comprise arranging each thermally conductive light radiation reflector with at least one extruded thermally conductive and light reflective fin radially outwardly from the central axis.

17. The method of claim 11, in which the method further comprises configuring the assembly to emit light in one of a Type III pattern and a Type V pattern.

* * * * *